United States Patent [19]

Caruso et al.

[11] Patent Number: 4,636,761

[45] Date of Patent: Jan. 13, 1987

[54] HIGH RELIABILITY SOLENOID SWITCH

[75] Inventors: Peter J. Caruso, Wayne; Robert R. Townsend, Towaco, both of N.J.

[73] Assignee: Allied Corporation, Morristown, N.J.

[21] Appl. No.: 684,832

[22] Filed: Dec. 21, 1984

Related U.S. Application Data

[63] Continuation-in-part of Ser. No. 526,850, Aug. 26, 1980, Pat. No. 4,502,030.

[51] Int. Cl.[4] ..... H01H 51/08

[52] U.S. Cl. ..... 335/140; 74/21

[58] Field of Search ..... 335/136, 137, 138, 139, 335/140, 123, 177, 184; 74/21

[56] References Cited

U.S. PATENT DOCUMENTS

| | | | |
|---|---|---|---|
| 516,063 | 3/1894 | Pendergrass et al. | 74/21 |
| 1,789,275 | 1/1931 | Howe | 335/184 |
| 3,223,802 | 12/1965 | Horst | 335/184 |
| 3,605,050 | 9/1971 | Goldman et al. | 335/164 |
| 4,331,845 | 5/1982 | Caruso | 335/184 |

*Primary Examiner*—Michael L. Gellner
*Assistant Examiner*—Brian W. Brown
*Attorney, Agent, or Firm*—Stan Protigal; Howard Massung

[57] ABSTRACT

A fail-safe solenoid switching mechanism (11) uses a reciprocating switch (15) to establish make-or-break connections. In order to increase the effective life of shorting bars on the switch, the switch's reciprocating part 23 is rotated by a ratcheting mechanism each time the switch (15) is cycled.

Advantages include enhanced reliability, even when the switching mechanism (11) sees extended quiescant periods between operations.

14 Claims, 5 Drawing Figures

HIGH RELIABILITY SOLENOID SWITCH

CROSS REFERENCE TO RELATED APPLICATION

This is a continuation-in-part of U.S. patent application Ser. No. 526,850, filed Aug. 26, 1980, now U.S. Pat. No. 4,502,030.

BACKGROUND OF THE INVENTION

This invention relates to electrical switches and more particularly to electrical solenoid switches in which a switch operator is caused to move by electromagnetic coils in order to make or break a circuit. In particular, the present invention relates to a solenoid switch which is positively actuated in two directions by a solenoid arrangement.

In certain switch applications, equipment containing a switch might not be used for extended periods of time. It may be further important that the switch be tamper proof to the extent that unauthorized personnel cannot turn the equipment on and, when the equipment has been turned on, the equipment cannot be turned off except under certain circumstances. Thus, while the switch may be periodically tested, the frequency of such testing is necessarily limited in order to reduce costs and to discourage tampering. Long quiescent periods create unique problems of wear and corrosion. The switch must be able to operate in a reasonably "fail-safe" manner when operation of the switched equipment is needed, so it is therefore necessary that such wear and corrosion problems be overcome.

In enhancing the reliability of such switch units, it is important that the switch be able to be operated reliably for a large number of cycles without preventative maintenance. The switch must have arc suppression capabilities. The use of an arc suppression circuit must be avoided because of the possibility that circuit elements within the arc suppression circuit can fail either on their own or with the aid of tampering. Arcing and other contact wear factors become more significant when high current levels, such as 50 amperes, are switched. The effects of pitting and other types of wear on the contact surfaces must also be minimized. Furthermore, these arc suppression problems, which become magnified in outer space environments in which a vacuum is present, must be minimized.

SUMMARY OF THE INVENTION

In accordance with the present invention, a ratcheting mechanism is incorporated into a slide switch. The slide switch includes a cylindrical armature having shorting rings on its surface and a plurality of stator beam contacts which extend about the armature and are biased against the armature. A ratchet mechanism associated with one of the actuator levers causes the armature to rotate when the switch is operated in one direction. This rotation ensures that wear on contacting members of the armature is evenly distributed about the armature.

This invention provides a means to impart a controlled, variable rotation to a driven member. The mechanism consists of an offset drive arm, two pivots, a pawl and a ratchet wheel. This permits the member to be rotated in very precise, controlled increments to provide a "fresh" or "new" bearing surface to contacting members each time the driven member is cycled. The system requires no separate or dedicated operating power, but instead derives its motion from unit operating force. The invention is applicable to switches, optical devices, bearing rods and similar devices, lends itself to miniature as well as very large operating devices, and is readily adaptable to existing devices. Advantages include long contact life and assurance of positive switching function after long periods of quiescent operation. The present invention permits high current levels to be switched from a relatively small assembly.

DETAILED DESCRIPTION OF THE PREFERRED EMBODIMENT

Figure 1:
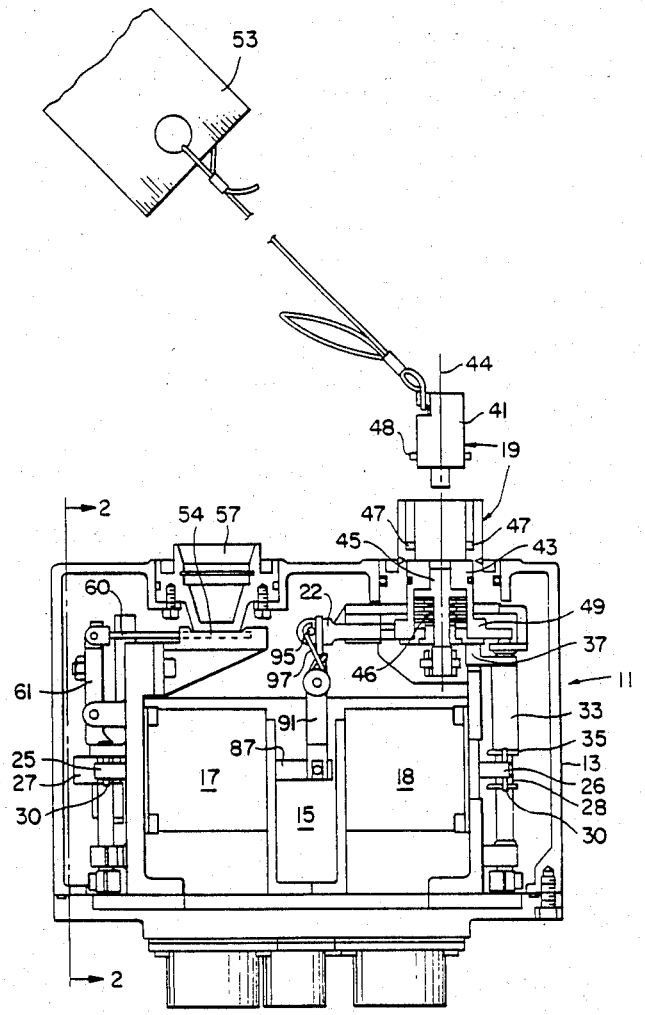
FIG. 1 is a partially cut-away view of a switch assembly constructed in accordance with the preferred embodiment of the invention, showing the actuation mechanism.
Figure 2:
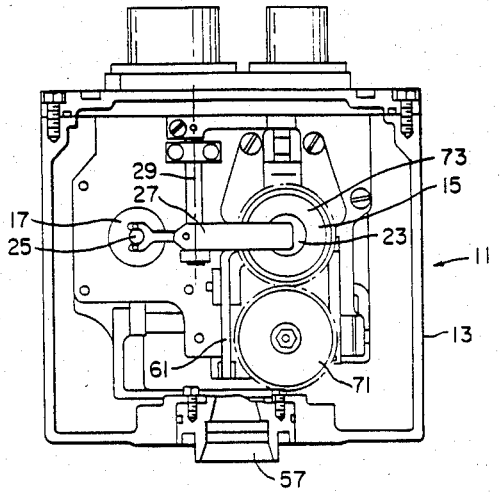
FIG. 2 is a sectional view taken along lines 2—2 of FIG. 1, showing a connection between the actuator mechanism and the switch in an end view.

Referring to FIGS. 1 and 2, a switching assembly 11 constructed in accordance with a preferred embodiment of the invention includes a housing 13, a cylindrical sliding switch 15, a pair of solenoid actuators 17, 18 and a manually operated safing mechanism 19. Actuator 17 is an "arming" actuator, meaning that the powering of the "arming" actuator 17 is required to position the switch 15 in an "on" status. Actuator 18 is a "safing" actuator, meaning that powering the "safing" actuator 18 causes the switch 15 to be moved to an "off" status. The "arming" actuator 17 may be overriden by the manually operated safing mechanism 19 which in turn, can be locked into its overriding position by a catch 22. The switch 15 has an armature 23 which is reciprocated to change between "off" and "on" statuses. The actuators 17, 18 each have plungers 25, 26, respectively, which move in response to powering of the actuators 17, 18. As viewed in FIG. 1, the "arming" actuator's plunger 25 moves to the left when actuated. The "safing" actuator's plunger 26 moves to the right when actuated. A pair of links 27, 28 are used to connect the plungers 25, 26 to the switch armature 23. The links 27, 28 are directly connected to their respective plungers 25, 26 by pins 30. No connection between the links 27, 28 and the armature 23 is provided. The links 27, 28 effect mechanical operation of the switch 15 by pressing the switch's armature 23 from the end of the armature 23 in a direction parallel to the movement of the armature 23. The links 27, 28 are positioned to have a clearance of 3.5 mm (0.140") each with respect to the armature 23, for a collective clearance of 7 mm.

Referring to FIG. 1, a pivot rod 33 is connected to a manually operated safing mechanism 19 and link 28, associated with the "safing" actuator 18. The connection to link 28 is effected via a short link 35, which is connected to the "safing" actuator's plunger 26 by means of its pin 30. The pivot rod 33, and consequently the short link 35, pivot along the same axis as link 28. Pivot rod 33 is caused to pivot by the movement of the "safing" plunger 26 and by a cam follower 37. Whenever the cam follower 37 is moved, causing the pivot rod 33 to move, the "safing" plunger is also forced to move.

The manually operated "safing" mechanism 19 includes a specialized drive tool 41 and a rotary assembly 43, both of which rotate along axis 44. A plunger 45, biased by a spring 46, is depressed whenever the specialized drive tool 41 is inserted into the rotary assembly 43. A pair of slots 47 made with cooperating pins 48 retain the specialized drive tool 41 in position against the plunger 45 whenever the rotary assembly 43 and tool 41 are turned to the overriding position. In the overriding position, a lower extension 49 of the rotary assembly 43 engages the cam follower 37, forcing the "safing" plunger 26 to a position which it would hold when the "safing" actuator 18 is powered. The rotary assembly 43 cannot be rotated in such a way as to force the pivot rod 33 to disengage the "safing" actuator 18. The specialized drive tool 41 has a streamer 53 attached thereto in order to discourage people from attempting to operate equipment, such as a vehicle associated with the switch assembly 11, when the manually operated safing mechanism 19 is in engagement with the cam follower 37.

By providing an appropriate slot (not shown) in the lower extension 49, the cam follower can be used to provide a detent at the overriding and at the disengaged positions.

Referring to FIGS. 1 and 2, a flag 54 is located adjacent a viewing sight 57 and indicates whether the switch 15 is in the "on" or "off" status. The flag 54 is connected by a rod 60, a lever 61 and a second rod (not shown) to the switch's armature 23. The position of the flag 54, therefore, corresponds to the position of the armature 23, indicating the status of the switch 15. The flag 54 is preferably marked with appropriate colored markings so that the status of the switch 15 may be checked by viewing the flag 54 through the viewing sight 57.

Figure 3:
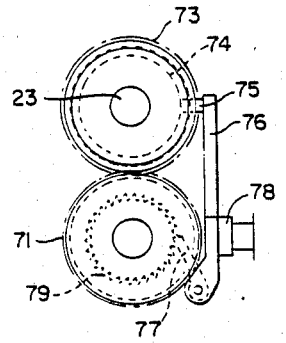
FIG. 3 shows an end view of a ratchet mechanism used in the switching assembly of FIGS. 1 and 2.
Figure 4:
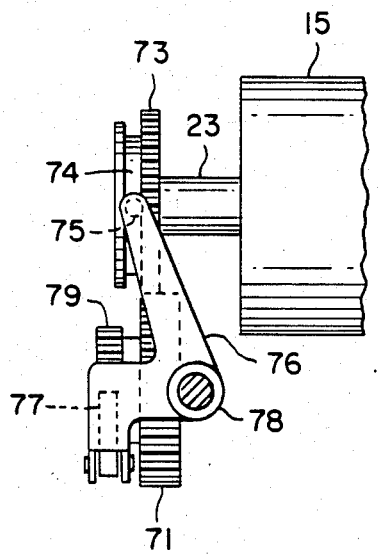
FIG. 4 is a side view showing details of the ratcheting mechanism of FIG. 3.
Figure 5:
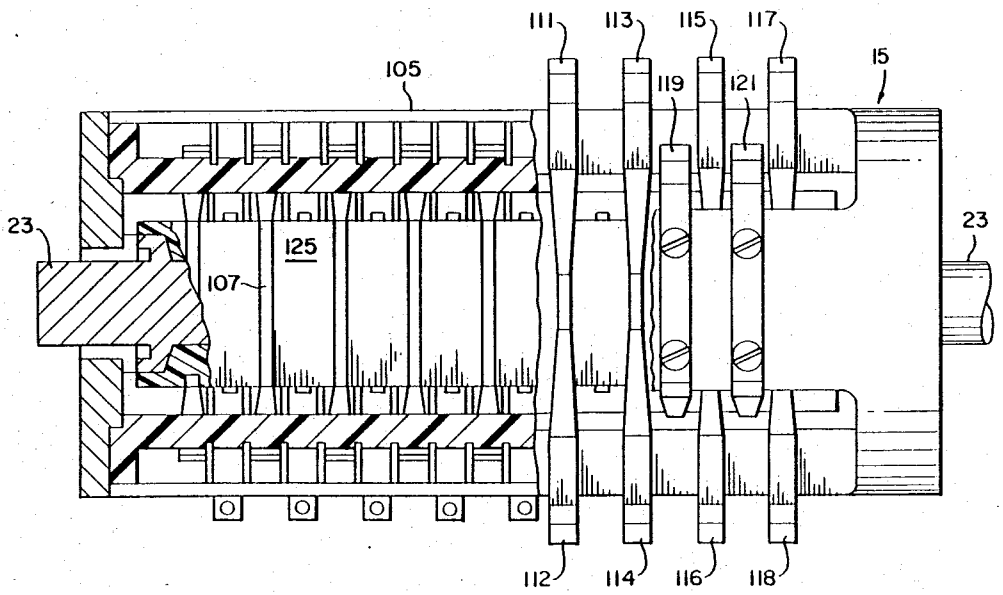
FIG. 5 shows a partially sectioned view of the switch used in the switching assembly of FIGS. 1 and 2.

Referring to FIGS. 2–4, a ratcheting wheel 71 and a driven wheel 73 are used to effect rotation of the armature 23 every time the armature 23 is reciprocated. The driven wheel 73 has a groove 74 cut from its perimeter, and a follower 75 rides in the groove 74. The follower 75 is attached to an arm 76. When the armature 23 reciprocates, the driven wheel 73 travels with it, causing the arm 76, supporting a pawl 77, to pivot about a pivot 78. This causes the pawl 77 to move against a series of ratchets 79 fixed to the ratcheting wheel 71. The ratcheting wheel 71, thus rotated, rotates the driven wheel 73 in the opposite direction whenever the armature 23 moves toward the "on" status. The aramture 23, being fixed to the driven wheel 73, thus rotates with it.

The pawl 77 and ratchets 79 ensure rotation of the ratcheting wheel 71 by establishing a fixed amount of rotation upon each cycle of arm 76 about its pivot 78. The amount of rotation of the ratcheting wheel is set by the distance that the pawl 77 moves as a result of the movement of the follower 75 and by the pitch of the ratchets 79.

Force for effecting rotation is exerted by the follower 75 as it rides in the groove 74, as transferred to the ratchets 79. The pawl 77 forces the ratcheting wheel 71 in only one direction, so that force is exerted through the arm 76 and pawl 77 in one direction only. This force can be determined by the geometric relationship of parts 21–23, and 71–79, and the force of reciprocation of the switch armature 23.

The "arming" plunger 25 has an extension 87 which extends in the direction of the "safing" actuator 18 and has attached thereto a lock-out link 91. The catch 22 is aligned with the lock-out link 91. As viewed in FIG. 1, movement of the "arming" plunger 25 to the right (power off, normal position) causes the lock-out link 91 to force the catch 22 to the left by means of a catch pin 95.

A spring 97 biases the catch 22 to the right as viewed in FIG. 1, when the "arming" solenoid 17 is powered. The catch 22 fits into a slot (not shown) on the rotary assembly 43 of the manually operated safing mechanism 19. The slot is positioned so that it lines up with the catch 22 whenever the rotary assembly 43 is turned to a "safe" position. If the "arming" solenoid 17 is powered at any time when the rotary assembly 43 is in the "safe" position, the catch 22 will drop into the slot due to bias by the spring 97, thus acting as a holding latch to prevent the rotary assembly 43 from being counter-rotated away from the "safe" position. As a result, the specialized drive tool 41, with its streamer 53, is prevented from being removed.

The ability of the "arming" plunger 25 to move sufficiently to allow the catch 22 to fit into the slot is made possible by the 3.5 mm clearance between link 27 and the armature 23. For this reason, even though the locked position of the rotary assembly 43 prevents the armature 23 from being moved to an "on" position, the "arming" plunger 25 can be moved sufficiently to allow the catch 22 to engage its slot.

Referring to FIG. 4, the switch 15 includes the reciprocating armature 23 and a housing 105. The armature 23 is a slide carrier which has a plurality of shorting bars 107 thereon, which connect contact leaves 111–121 which are arranged in aligned pairs 111, 112, typical. The shorting rings 107 are inserted into a dielectric insulating material 125 and are preferably made from a noble metal. The contact leaves 111–121 are preferably made of a resilient material such as a copper alloy known in the trade as "beryllium copper alloy 25". The contact leaves 111–121 have contact buttons (not shown) which brush the shorting bars 107 and are preferably made of a noble metal alloy, such as silver cadmium oxide or a gold alloy, the exact choice being dependent on whether the particular contact button is used for high current or as part of a low impedance circuit carrying low current levels.

As stated supra, because the driven gear 73 rotates upon reciprocation, the armature 23 is also rotated. The armature 23, containing the shorting bars 107, has a circular cross-section. Therefore, upon rotation of the armature 23, different parts of the shorting bars 107 are contacted by the contacts 111–121. This limited controlled rotation distributes the wear on the shorting bars 107 along the outer circumference of the shorting bars 107, there presenting a clean contact area for each current application, resulting in an extremely low contact resistance.

While the specific features in the preferred embodiment have been described, it is possible to implement the inventive conceps herein by different means. For this reason, the present invention should be read as limited only by the appended claims.

What is claimed is:

1. Switching assembly having at at least one make-or-break connection, which is switchable between a first status and a second status in response to electrical signals, characterized by:

(a) switch operator means;

(b) a slideable contact carrier, the status of the make-or-break connection being controlled by a reciprocal movement of the contact carrier, the contact carrier being connected to the switch operator means so that a force from the switch operator means biases the contact carrier to effect said movement;

(c) the contact carrier having at least one shorting bar to establish said make-or-break connection, the shorting bar having a circular cross-section;

(d) a ratcheting mechanism connected to the contact carrier and responsive to the reciprocal movement of the contact carrier; and (e) the ratcheting means including means to cause the contact carrier to be rotated by a predetermined amount for each complete reciprocal movement of the contact carrier.

2. Switching assembly as described in claim 1, further characterized by:

the ratcheting means including a geared wheel coaxial with and firxed to the contact carrier, and a pawl which acts against ratchets in order to rotate the geared wheel.

3. Switching assembly as described in claim 2, further characterized by:

the pawl acting against the ratchets to rotate the geared wheel in one direction of said reciprocal movement of the contact carrier and the pawl withdrawing across at least one of said ratchets in an opposite direction of said reciprocal movement of the contact carrier.

4. Switching assembly as described in claim 3, further characterized by:

the contact carrier being fixed to a member having a groove thereon;

a pivoting arm which is pivotable with respect to the contact carrier;

the pivoting arm including a follower which rides in said groove; and the pawl having an attachment point with the pivoting arm causes movement of the pawl with respect to the ratchets.

5. Switching assembly as described in claim 1, further characterized by:

the contact carrier including a cylindrical portion of substantially insulative material having a plurality of shorting rings thereon.

6. Switching assembly as described in claim 5, further characterized by:

the shorting rings being clad onto an outer surface of the cylindrical portion.

7. Switching assembly as described in claim 5, further characterized by:

an outer surface of the cylindrical portion being formed by the shorting rings interspaced between substantially insulative members.

8. Switching assembly having at least one make-or-break connection, which is switchable between a first status and a second status in response to electrical signals, characterized by:

(a) solenoid means providing force in response to the electrical signals;

(b) a moveable switch armature, the status of the make-or-break connection being controlled by a reciprocal movement of the switch armature, the switch armature being connected to the solenoid means so that the force from the solenoid biases the armature to effect said movement when the solenoid responds to said electrical signals;

(c) the switch armature having at least one shorting bar to establish said make-or-break connection, the shorting bar having a circular cross-section;

(d) a ratcheting mechanism connected to the switch armature and responsive to the reciprocal movement of the switch armature; and (e) the ratcheting means including means to cause the switch armature to be rotated by a predetermined amount for each complete reciprocal movement of the switch armature.

9. Switching assembly as described in claim 8, further characterized by:

the ratcheting means including a geared wheel coaxial with and fixed to the slide carrier, and a pawl which acts against ratchets in order to rotate the geared wheel.

10. Switching assembly as described in claim 9 further characterized by:

the pawl acting against the geared wheel to rotate the geared wheel in one direction of said reciprocal movement of the switch armature and the pawl withdrawing across at least one gear on said geared wheel in an opposite direction of said reciprocal movement of the switch armature.

11. Switching assembly as described in claim 10, further characterized by:

the switch armature having a groove thereon;

a pivoting arm which is pivotable with respect to the switch armature;

the pivoting arm including a follower which rides in said groove; and the pawl having an attachment point with the pivoting arm so that the pivoting arm causes movement of the pawl with respect to the geared wheel.

12. Switching assembly as described in claim 8, further characterized by:

the switch armature including a cylindrical portion of substantially insulative material having a plurality of shorting rings thereon.

13. Switching assembly as described in claim 12, furhter characterized by:

the shorting rings being clad onto an outer surface of the cylindrical portion.

14. Switching assembly as described in claim 12, further characterized by:

an outer surface of the cylindrical portion being formed by the shorting rings interspaced between substantially insulative members.

* * * * *